US006241071B1

(12) United States Patent
Yamashita et al.

(10) Patent No.: US 6,241,071 B1
(45) Date of Patent: Jun. 5, 2001

(54) TREAD UNIT OF PASSENGER CONVEYER AND PASSENGER CONVEYER SYSTEM

(75) Inventors: Shu Yamashita; Toshihisa Honda; Yasumasa Haruta; Akira Noshita; Noboru Hiroshima, all of Tokyo; Kunihiko Murayama, Hyogo, all of (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/403,313

(22) PCT Filed: Mar. 18, 1998

(86) PCT No.: PCT/JP98/01134

§ 371 Date: Oct. 20, 1999

§ 102(e) Date: Oct. 20, 1999

(87) PCT Pub. No.: WO99/47448

PCT Pub. Date: Sep. 23, 1999

(51) Int. Cl.[7] ..... B66B 23/12
(52) U.S. Cl. ..... 198/333
(58) Field of Search ..... 198/333

(56) References Cited

U.S. PATENT DOCUMENTS

| | | | | |
|---|---|---|---|---|
| 2,085,076 | * | 6/1937 | Dunlop | 198/333 |
| 2,152,795 | * | 4/1939 | Dunlop | 198/333 |
| 2,214,580 | * | 9/1940 | Dunlop | 198/333 |
| 5,350,049 | * | 9/1994 | Ahls et al. | 198/333 |
| 5,358,089 | * | 10/1994 | Riedel | 198/333 |
| 6,039,167 | * | 3/2000 | Vellinga | 198/333 |

FOREIGN PATENT DOCUMENTS

| | | |
|---|---|---|
| 60-151881 | 10/1985 | (JP) . |
| 63-139808 | 6/1988 | (JP) . |
| WO9523758 | 9/1995 | (WO) . |

* cited by examiner

*Primary Examiner*—Joseph E. Valenza
(74) *Attorney, Agent, or Firm*—Leydig, Voit & Mayer, Ltd.

(57) ABSTRACT

A tread unit of a passenger conveyor includes: a tread, a tread reinforcing member and a riser which are made of fiber reinforced plastic made by knitting fibers together. The surfaces of the cleat portions of the tread and the riser are provided with surface treated layers in which the wear resistance and coefficient of friction are controlled. As a result of this construction, the aesthetic design of the tread unit and of the passenger conveyor system can be improved. In addition, the reduced weight of the tread unit contributes to labor-saving at the time of mounting, and a passenger conveyor system using these tread units can be reduced in size and weight as a whole.

10 Claims, 13 Drawing Sheets

TREAD UNIT OF PASSENGER CONVEYER AND PASSENGER CONVEYER SYSTEM

TECHNICAL FIELD

The present invention relates to a tread unit on which persons step for passenger conveyor systems such as escalators and moving walks. More particularly, the invention relates to a tread unit of a passenger conveyor, which is made of fiber reinforced plastic, and to a passenger conveyor system constructed by coupling a plurality of such tread units.

BACKGROUND ART

Aluminum die castings and steels are generally used as materials for each member of a tread and a riser that constitute a tread unit of a passenger conveyor such as an escalator. In recent years, tread units using fiber reinforced plastic (FRP) have also been proposed.

FIG. 13 shows a conventional tread unit of an escalator disclosed in Japanese Patent Application Laid-open No. Hei 7-330266, and FIG. 14 shows a tread unit of an escalator disclosed in WO 95/23758 using fiber reinforced plastic. In FIG. 13, reference numeral 101 denotes a tread, 102 denotes a reinforcing rib, 103 denotes a riser, and 106 denotes a bracket. This tread unit is made solely of aluminum die castings. Further, in FIG. 14, reference numerals 102*a* and 102*b* denote reinforcing ribs. This tread unit is made solely of fiber reinforced plastic.

Also, in Japanese Utility Model Application Laid-open No. Hei 6-8372, a sectional view of a tread of a passenger conveyor is shown and it discloses that the surface of the tread is provided with a film made of quartz sand thereby facilitating and reducing costs of non-slip processing. Further, in Japanese Patent Application Laid-open No. Sho 63-139808, it is disclosed that steel wires and rubber belts reinforced by woven fabrics are used as a conveying body.

As described above, most of the conventional tread units of passenger conveyors such as escalators are made of aluminum die castings, with some made of steel. In the case of using aluminum die castings, reinforcing members made of steel are arranged at the lower portion of the tread in order to ensure a prescribed rigidity. Accordingly, weight of the tread unit is increased, and from this arises problems such that the size of the escalator drive unit and the braking force are increased. Furthermore, conventional tread units have another problem in regards to the wear resistance treatment given to the surface of their treads. Since the surface of aluminum die castings provides only poor bond, flaking results, and this leads to defects in reliability and the aesthetic design of the tread unit. Further, in the fiber reinforced plastic proposed in FIG. 14, since short fibers that are several centimeters long or so are used as reinforcement, rigidity and strength are not adequate, and thus an extremely complicated reinforcing rib structure is required at the lower portion of the tread. From this arises still other problems in that structural defects easily occur due to poor wetting of resins, nonuniform distribution of reinforcement and the inclusion of voids and the like during the molding process at the time of manufacture, and the weight of the unit is increased. Also, these problems have caused increased production costs as well. Further, for conveyor belts used for conveying people, the cleats of the tread are only made of rubber, and thus their rigidity is low. As a result, people do not ride stably on such belts.

The present invention has been made to overcome the aforementioned problems. Therefore, an object of the present invention is to obtain a tread unit made of fiber reinforced plastics (hereinafter referred to as an "FRP tread unit") and a passenger conveyor system using such an FRP tread unit, which ensures adequate rigidity and strength using reinforcements made of continuous long fibers, which allows a highly reliable surface treatment to be given, and in which diversified aesthetic designs and reductions in weight can be implemented.

DISCLOSURE OF THE INVENTION

According to a first aspect of the present invention, there is provided a tread unit of a passenger conveyor comprising: a tread portion onto which load is applied and which has a cleat portion on an obverse surface thereof; a reinforcing portion provided on a reverse surface of the tread for reinforcing the tread; and a riser portion having a cleat portion on a front surface thereof and being formed so as to project downward from one end of the tread portion, wherein at least one of the tread portion and the riser portion is made of fiber reinforced plastic which is reinforced by a reinforcement made of knitted continuous long fibers. According to this construction, a three dimensional knitted fabric, a hollow woven fabric, or a multi-axial braid is used as a molding substrate, and thus the reinforcement made of a continuous long fiber can be oriented efficiently in any direction. Hence, a tread unit can be designed with the specific rigidity and specific strength of the whole unit adequately improved.

According to a second aspect of the present invention, in the tread unit of the first aspect of the invention, at least one of the tread portion and the riser portion is made of fiber reinforced plastic which is reinforced by a reinforcement made of continuous long fibers knitted in three dimensions in accordance with a pitch of the cleat portion. According to this construction, a tread unit can be designed with the specific rigidity and specific strength of the whole unit adequately improved.

According to a third aspect of the present invention, in the tread unit of the first aspect of the invention, the cleat portion of the tread portion or the riser portion is provided with wear resistant means and friction characteristic control means. According to this construction, the surface of the reinforced fiber is provided with a surface treated layer in which wear resistance and coefficient of friction are controlled, and thus there will be no impairment of the aesthetic design due to flaking.

According to a fourth aspect of the present invention, in the tread unit of the first aspect of the invention, the reinforcing portion is made of resin which is reinforced by a reinforcement made of a plurality of continuous long fibers. According to this construction, the reinforcing portion can be made light, and its strength can be improved easily.

According to a fifth aspect of the present invention, in the tread unit of the fourth aspect of the invention, a matrix resin of the reinforcement of the reinforcing portion is an elastic body. According to this construction, a stable ride will be provided.

According to a sixth aspect of the present invention, in the tread unit of the fourth aspect of the invention, the reinforcing portion is further provided with noise insulation means. According to this construction, a tread unit having high noise insulation effect can be provided easily.

According to a seventh aspect of the present invention, in the tread unit of the fourth aspect of the invention, at least two of the tread portion, the reinforcing portion and the riser portion which are constructed of fiber reinforced materials are sutured together with fibers. According to this construction, a tread unit can be manufactured easily.

According to an eighth aspect of the present invention, in the tread unit of the first or the fourth aspect of the invention, the fibers of the reinforcement or thematrix resin of the fiber reinforced plastic are colored. According to this construction, a desired indication and expression can be given to a tread unit.

A passenger conveyor system of the present invention comprises a plurality of the tread units of a passenger conveyor as recited in any one of the first to eighth aspects, the tread units being coupled to one another. According to this construction, the weight of the whole system can be reduced, and its aesthetic design can be improved.

BEST MODES FOR CARRYING OUT THE INVENTION

Figure 1:
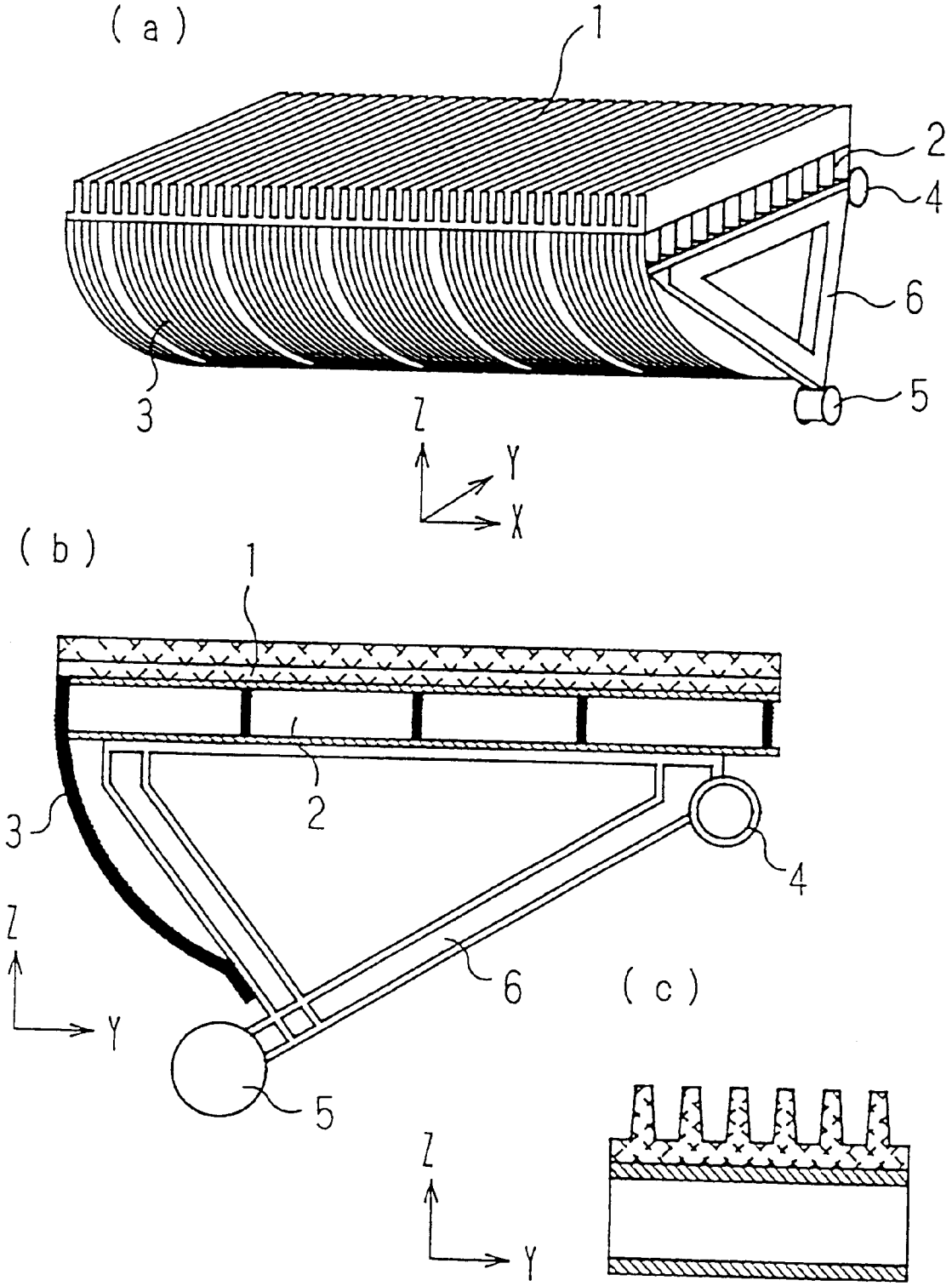
FIG. 1 contains a perspective view of an FRP tread unit according to a first embodiment of the present invention, a schematic diagram as viewed in the direction X, and a diagram illustrating a cleat portion.

In the present invention, reinforcements are arranged in the X and Y directions (as shown in FIG. 1 referred to in the following embodiments) of the cleat base portion of a tread in a molding substrate in order to, e.g., suppress the deflection of and to improve the rigidity of the whole step. Further, in the cleat portion of the tread, reinforcements are similarly arranged in the Y and Z directions in order to ensure rigidity and strength. In this case, more reinforcements are arranged in the X direction of the cleat base portion of the tread and in the Y direction of the cleat portion of the tread, taking their contribution to the rigidity into account. Further, in the tread reinforcing member as well, reinforcements are arranged in the X and Y directions of the surface portion and in the X and Z directions of the rib portion (the directions are respectively shown in FIG. 3 referred to in the following embodiments). In this case also, more reinforcements are arranged in the Y direction of the surface portion and in the X direction of the rib portion, similarly taking their contribution to rigidity into account. As a result of these arrangements, the rigidity and strength in the required directions are ensured. Further, a foam is used to fill the spaces surrounded by the surface portion and the rib portion of the tread reinforcing member, so that insulation from vibration and noise emanating from the drive unit portion below the step is improved. Still further, by coating a quartz-powder-filled resin over the surface of the cleat portion of the tread, the wear resistance of the cleat portion is improved, thereby ensuring such a coefficient of friction as to prevent shoes from slipping. Further, in order to prevent shoes from being caught in the riser, a wax-mixed resin is coated onto the surface of the cleat portion of the riser, so that such a coefficient of friction as to prevent shoes from slipping and being caught in the riser is ensured. Since the coated resin has a composition similar to the resin used for the tread and the riser, a strong bond is provided, and thus defects in aesthetic design due to flaking observed in conventional coatings to metals can be prevented.

Further, by coloring the continuous long fibers which are reinforcements, and the resin mixture, using a pigment and then by molding them, a desired aesthetic design can be given to the tread unit. In addition, defects in aesthetic design due to flaking observed in conventional color coatings can be prevented.

Still further, the passenger conveyor system of the present invention is constructed of FRP tread units, so that the whole system is lighter in weight and has an improved aesthetic design and ride.

Embodiments of the present invention will now be described with reference to the drawings.

Embodiment 1

FIG. 1 is a diagram for illustrating an FRP tread unit according to Embodiment 1 of the present invention. FIG. 1 shows a single step constituting an escalator, which is a passenger conveyor system. FIG. 1(*a*) is a perspective view, and (b) is a schematic diagram as viewed in the X direction of (a). In the figure, a tread unit comprises a tread 1, a tread reinforcing member 2, a riser 3, bearings 4, and rollers 5. A driving portion for driving a plurality of steps drives the bearings 4 and the roller 5 that are coupled by brackets 6. Here, the tread 1, the tread reinforcing member 2 and the riser 3 are made of fiber reinforced plastics. FIG. 1(*c*) shows the structure of a cleat portion 7, which is a group of projections formed on the tread 1 and the riser 3.

Figure 2:
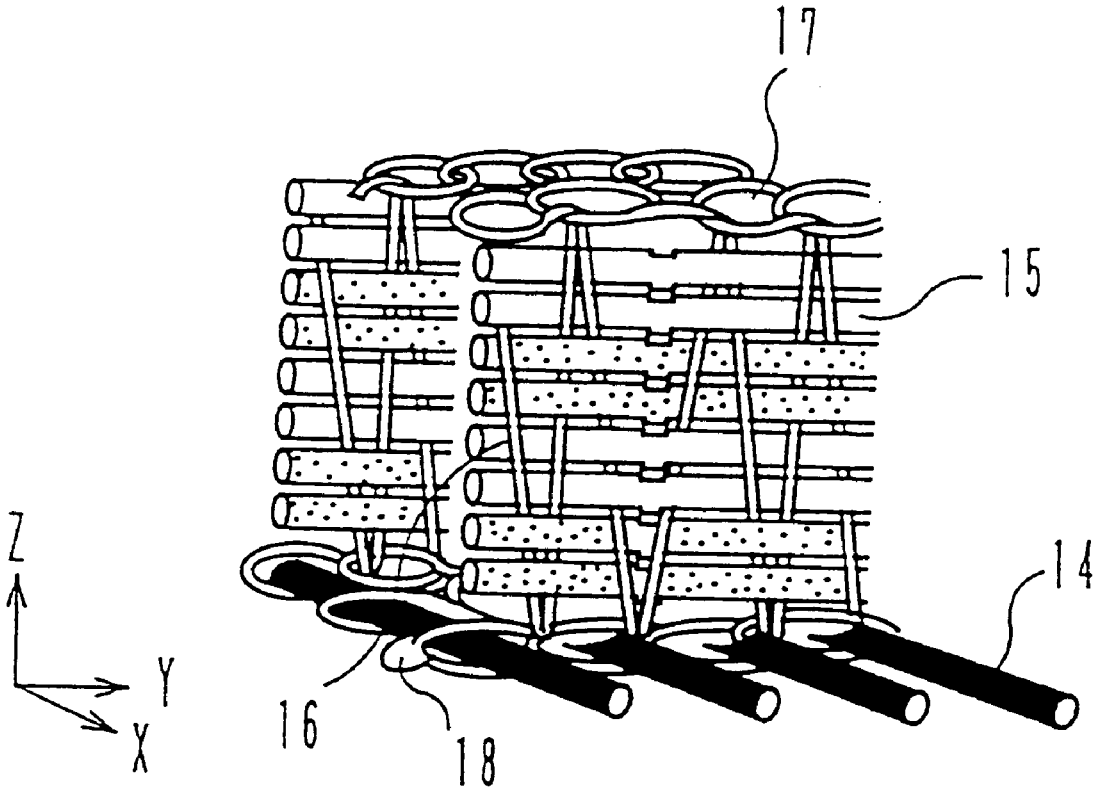
FIG. 2 is a sectional perspective view of a molding substrate for a tread and a riser of the FRP tread unit according to the first embodiment of the present invention.
Figure 3:
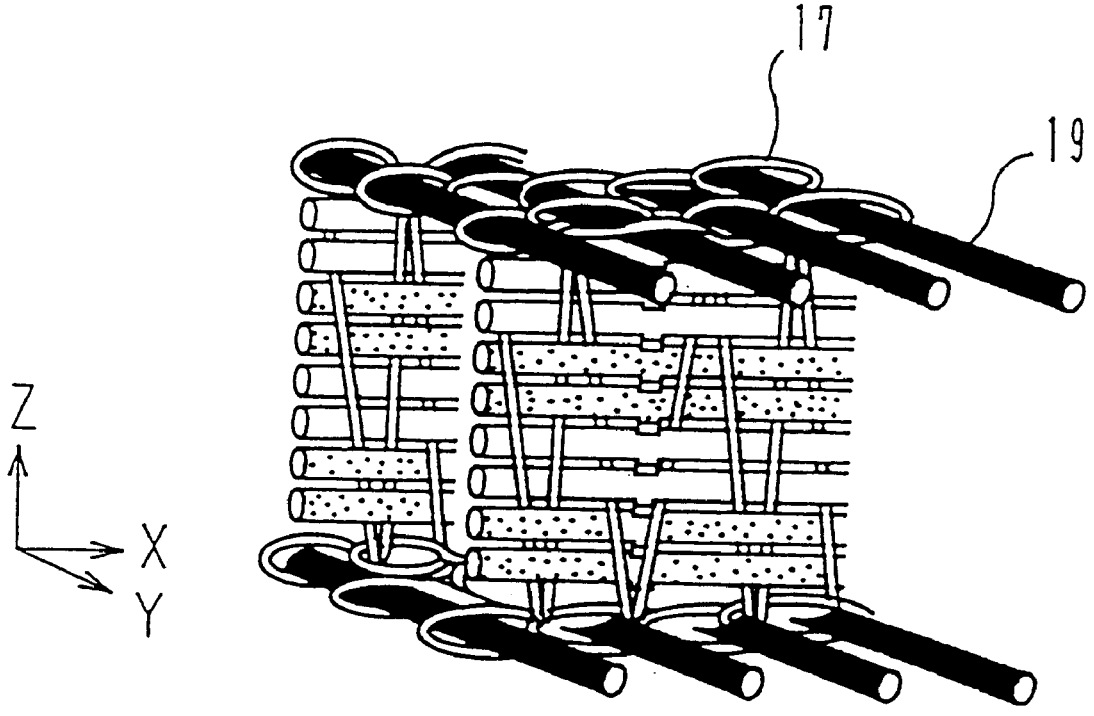
FIG. 3 is a sectional perspective view of a molding substrate for a tread reinforcing member of the FRP tread unit according to the first embodiment of the present invention.
Figure 4:
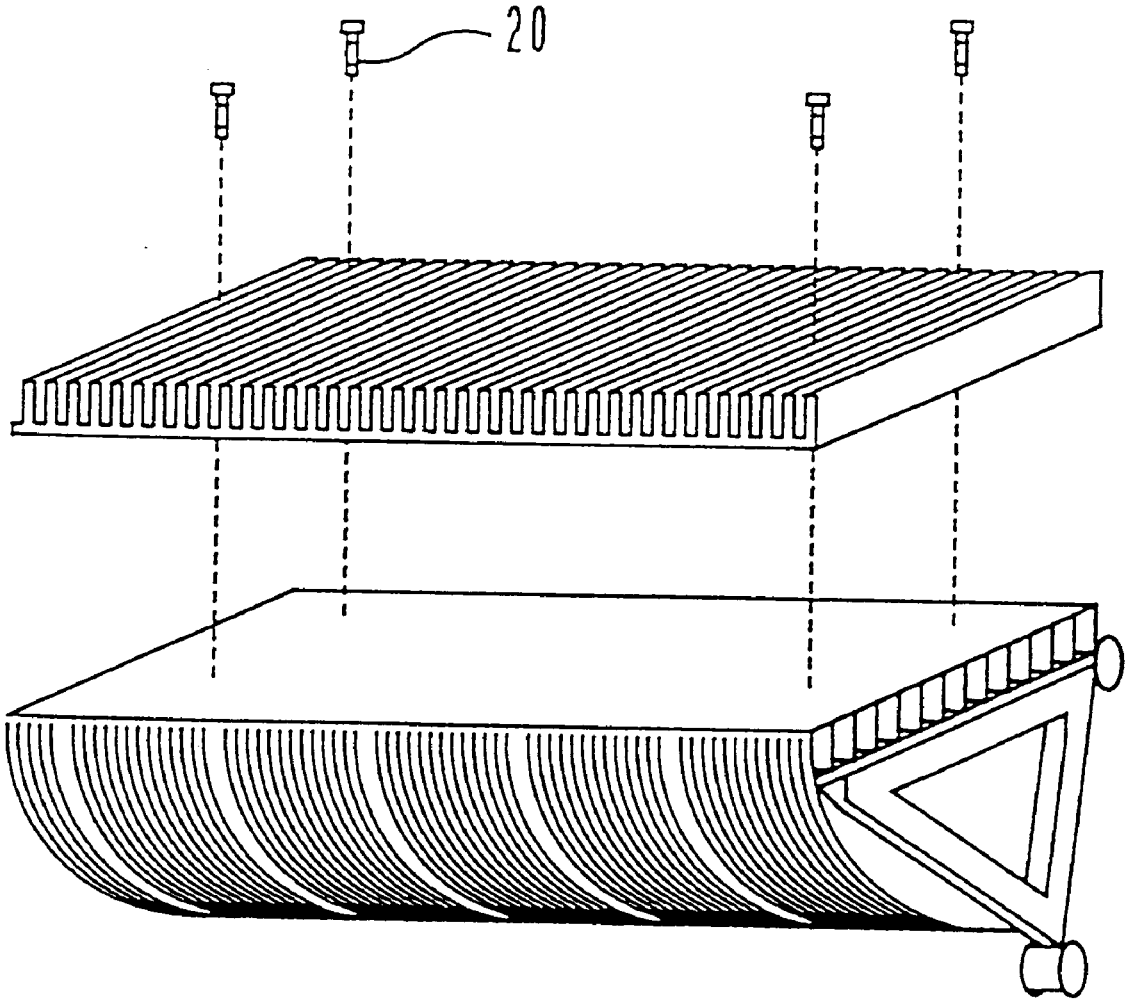
FIG. 4 is a perspective view showing a method of joining the molding substrates of the FRP tread unit according to the first embodiment of the present invention.

FIG. 2 is a schematic diagram showing in an enlarged form the structure of a fiber reinforced plastic used for the cleat portion 7 of FIG. 1. As shown in the figure, a three dimensional knitted molding substrate is used, in which insertion yarns 14 inserted in the X direction, insertion yarns 15 inserted in the Y direction and interlocking yarns 16 interlocked in the Z direction are arranged in the three, directions X, Y and Z, respectively. Top loop yarns 17 and base loop yarns 18 hold these insertion and interlocking yarns to thereby form the structure of the fiber reinforced plastic. FIG. 3 is a schematic diagram showing the structure of a fiber reinforced plastic used for the tread reinforcing member 2 shown in FIG. 1. As shown in the figure, the fiber reinforced plastic having a structure in which Y-direction insertion yarns 19 is inserted into the top loop yarn 17. The amounts of insertion of the insertion and interlocking yarns can be set to desired values. As a result, the fiber volume fraction (Vf) in each of the directions X, Y and Z can be set. The tread reinforcing member 2 and the riser 3 are integrally molded with the brackets inserted, while the tread 1 is molded separately. Finally, the step is fabricated using fastening bolts 20 as shown in FIG. 4. Thus, by separately molding only the tread, operability at the time of tread replacement due to damage or design changes of the cleat portion of the tread can be greatly improved. Here, the insertion, interlocking and loop yarns are glass continuous long fibers, and the matrix resin is made of an epoxy acrylate resin. Other types of inorganic or organic continuous filament yarns may be used as the insertion, interlocking and loop yarns, and other types of thermosetting or thermoplastic resins may be used for the matrix resin.

Table 1 compares the characteristics of the FRP tread unit manufactured under the following conditions with those of a conventional aluminum die cast tread unit. The comparison of characteristics is made in terms of the weight of the tread unit and of the maximum deflection and stress of the tread unit when a concentrated load of 300 kg is applied to the middle portion of each tread.

[Molding Conditions]

Molding substrate: Three dimensional knitted fabric Yarns used in molding substrate: Glass long fibers (piled yarns and fiber rovings)

Resin used for matrix: Flame retardant epoxy acrylate resins (viscosity at the time of molding is 150 cp)

Molding method: Resin transfer molding (RTM) method

Fiber volume fraction:

38% in X direction

38% in Y direction

8% in Z direction

TABLE 1

Comparison of Tread Unit Characteristics

| | Dimensions (mm) | Weight (kg) | Maximum deflection (mm) | Maximum stress ($Kgmm^2$) |
|---|---|---|---|---|
| FRP tread unit (Present invention) | 1004W × 400L × × 300H | 13.5 | 3.7 | 2.0 |
| conventional tread unit (Aluminum die castings) | | 18.3 | 3.8 | 3.0 |

The FRP tread unit of the present invention allows the glass continuous long fibers, which are reinforcements, to be arranged in the optimal directions efficiently, and allows the tread reinforcing structure to contribute effectively to improving the rigidity and strength of the whole tread unit. As is apparent from the results of Table 1, the FRP tread unit not only reduces the maximum deflection and stress but also exhibits a reduction of about 30% in weight compared with the conventional aluminum die casting unit.

Further, a tread unit using short fiber reinforced plastics as in conventional techniques not only requires a complicated support structure in order to obtain characteristics equivalent to those of the aluminum die cast unit, but also requires, in some cases, the use of metal as a reinforcing member, which in turn considerably increases both the cost and weight. In contrast, the present invention uses a three dimensional knitted fabric made of continuous long fibers, and thus the tread unit is provided with an adequate strength and can be made light as described above.

Embodiment 2

Figure 5:
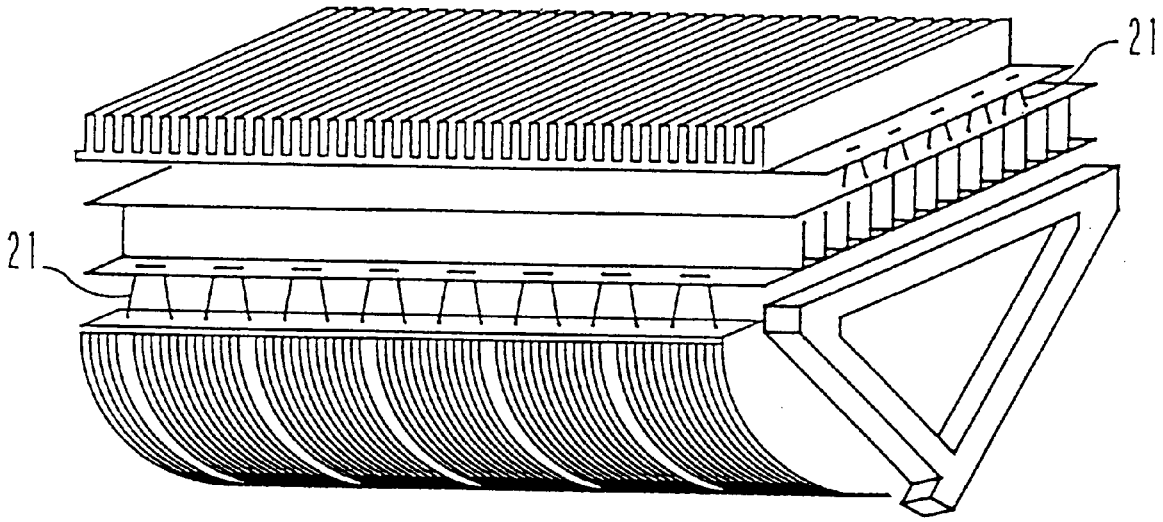
FIG. 5 is a perspective view showing a method of joining molding substrates of an FRP tread unit according to a second embodiment of the present invention.

Unlike Embodiment 1, respective molding substrates for the tread, tread reinforcing member and riser are sutured up in advance by sutures 21 as shown in FIG. 5, and the sewed body is set into a mold together with brackets. Then, the matrix resin is charged into the mold, and all of them are integrally molded. The molding conditions are similar to those of Embodiment 1.

Embodiment 3

Figure 6:
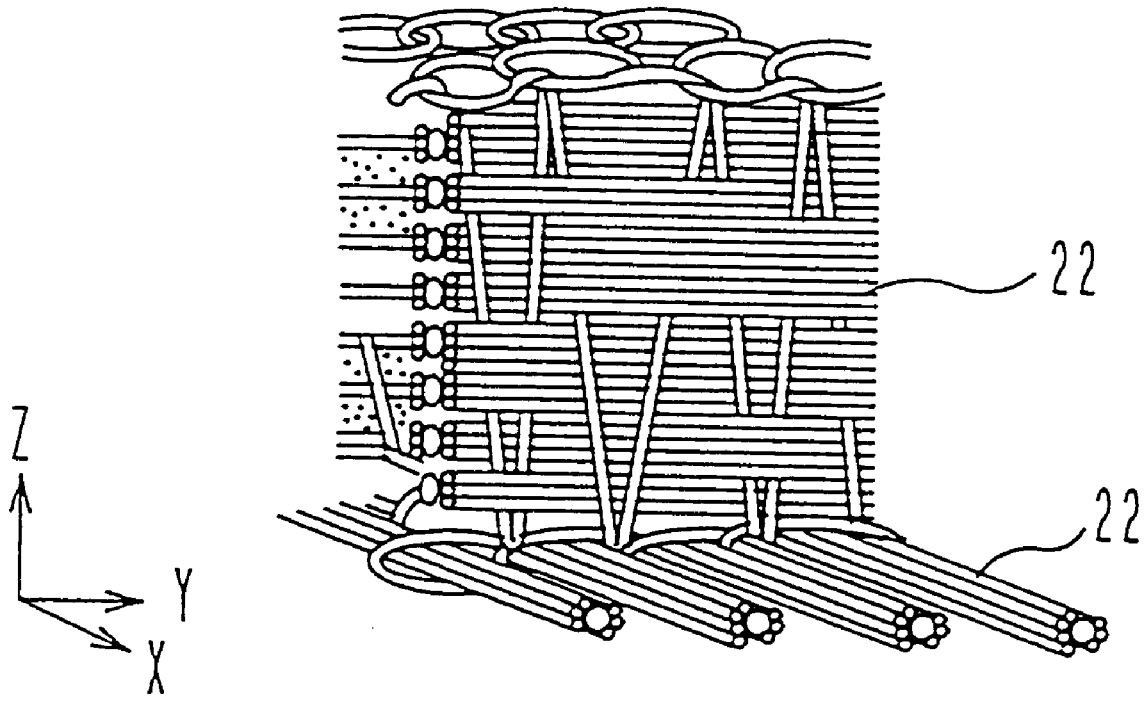
FIG. 6 is a perspective view of a molding substrate of an FRP tread unit according to a third embodiment of the present invention.

FIG. 6 is a perspective view of a tread molding substrate in Embodiment 3. In this embodiment, a thermoplastic resin is used as the matrix resin for molding. As shown in the figure, fibers 22 made of a polyamide resin (nylon 6) are knitted together with the X-direction and Y-direction insertion yarns, which are reinforcements, so that the molding substrates are formed by knitting. At the time of molding, only the fibers made of such a resin are fused and thereafter cooled to thereby shape the tread. The same applies to the tread reinforcing member and the riser. Any thermoplastic resin may be used as long as it can be formed into a fiber and knitted. Further, as another method using a thermoplastic resin, it is also acceptable to sprinkle a powdered resin over the molding substrates, and mold the molding substrates by a fusion method.

Embodiment 4

Figure 7:
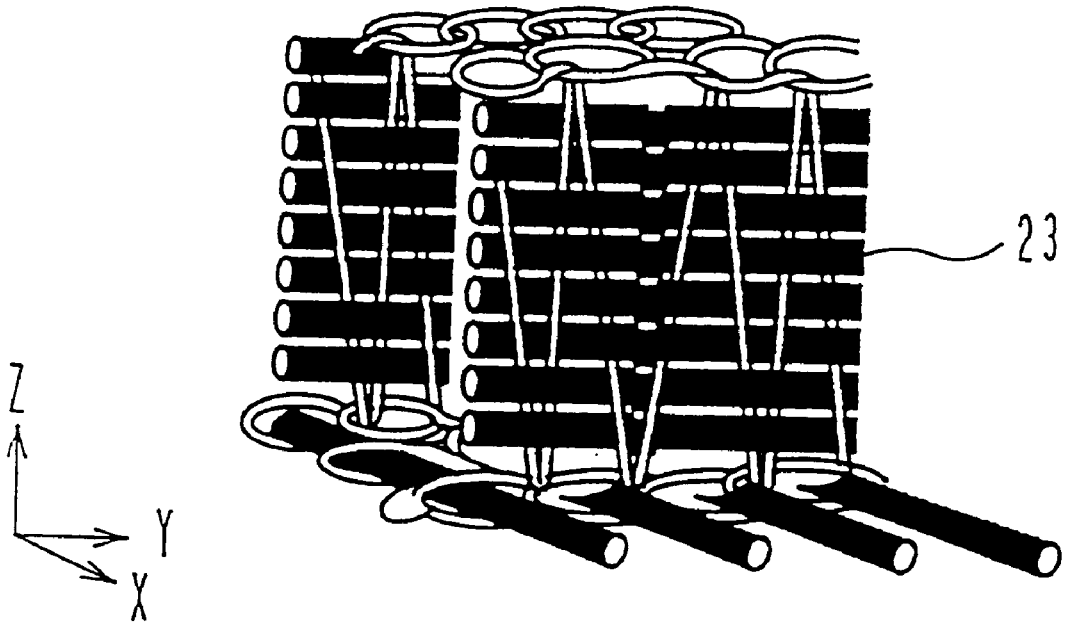
FIG. 7 is a perspective view of a molding substrate of an FRP tread unit according to a fourth embodiment of the present invention.

FIG. 7 is a perspective view of a tread molding substrate in Embodiment 4. In this embodiment, carbon fibers 23 whose modulus of elasticity is 65,000 $kg/mm^2$ are used as the insertion yarns, and glass fibers are used as the interlocking yarns of the substrate. The same applies to the molding substrates of the tread reinforcing member and the riser. The use of high-rigidity carbon fibers allows the weight of the whole unit to be reduced by 50% compared with the conventional aluminum die cast tread unit, and the tread reinforcing member can have a considerably compact design. Further, as the rigidity of the cleat portion of the tread has improved, the pitch between cleats can be reduced to about 4.5 mm, a reduction of about half the conventional pitch, which is about 9 mm. As a result, shoes or the like can be prevented from being caught in the cleat portion during the operation of the escalator. Aramid fibers and other liquid crystalline organic fibers can also be used as the interlocking yarns.

Embodiment 5

Figure 8:
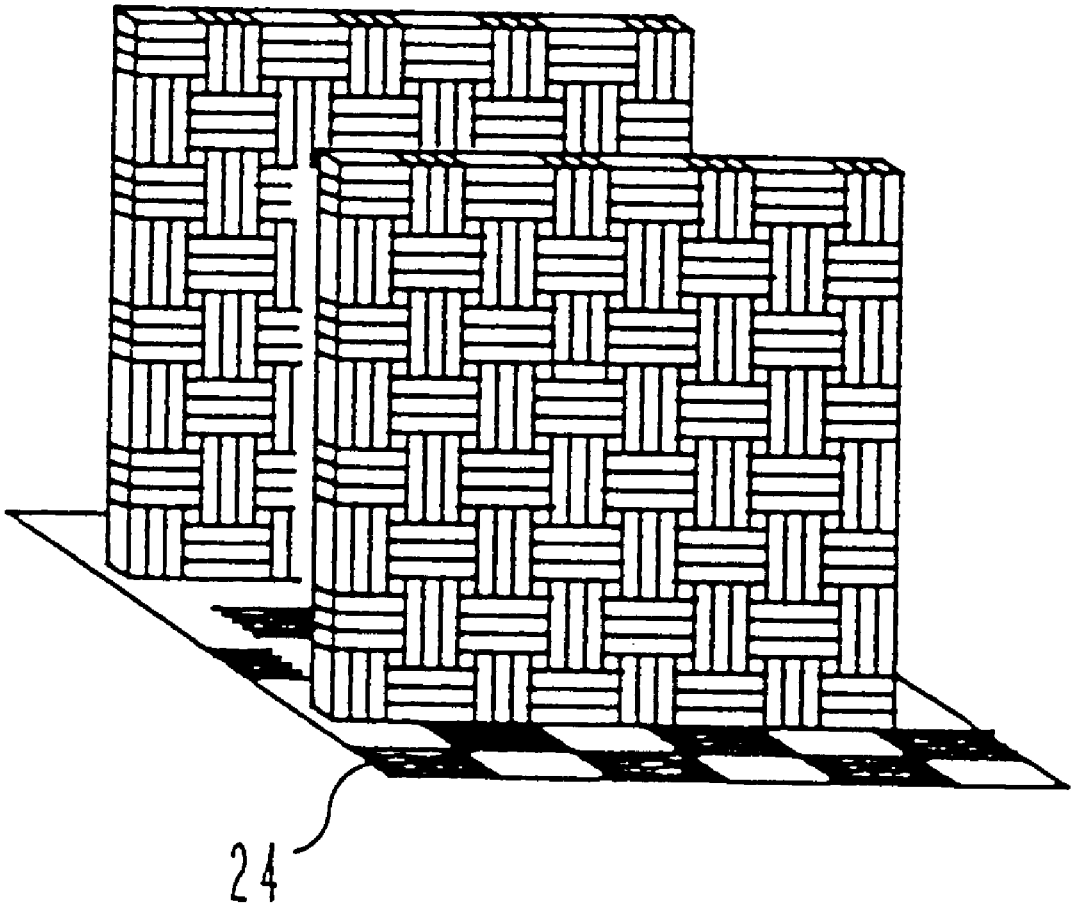
FIG. 8 is a sectional perspective view of a molding substrate for a tread and a riser of an FRP tread unit according to a fifth embodiment of the present invention.
Figure 9:
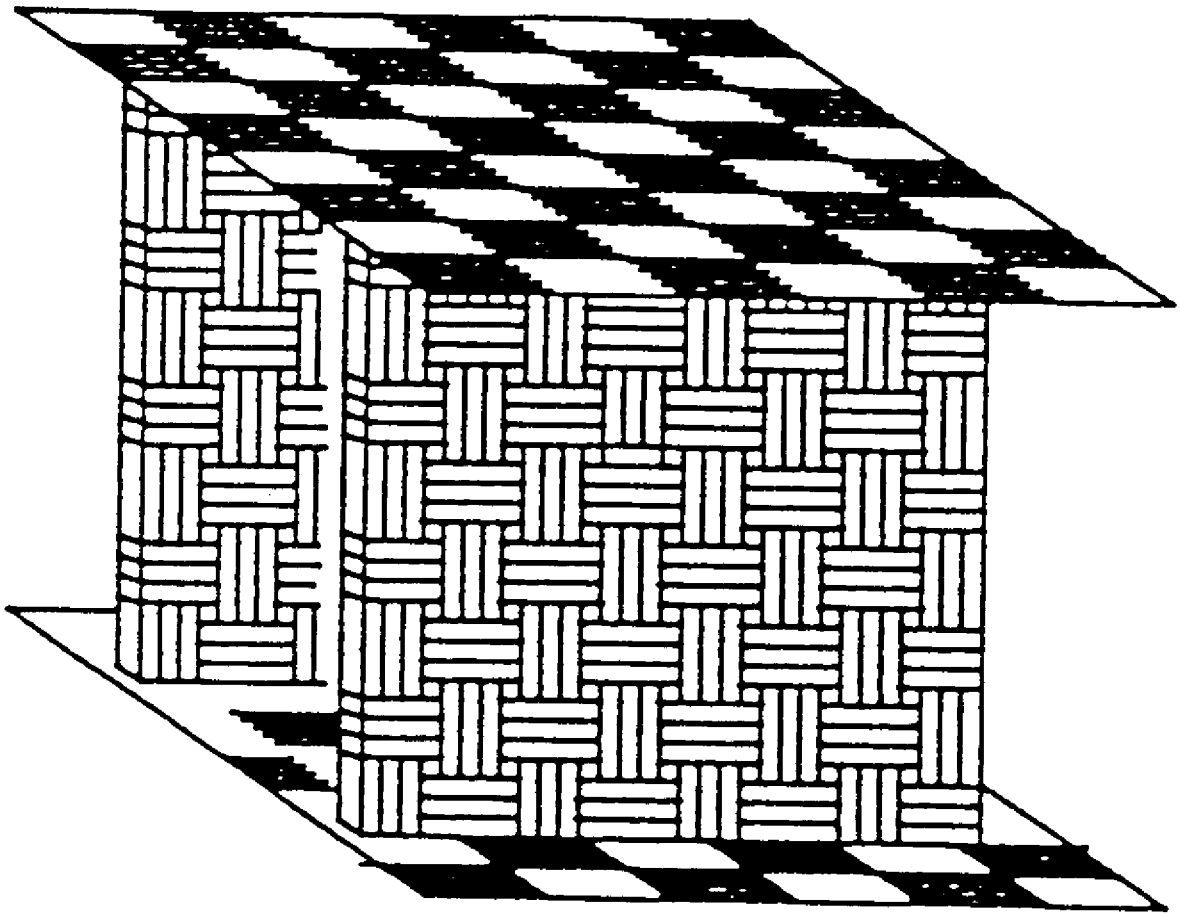
FIG. 9 is a sectional perspective view of a molding substrate for a tread reinforcing member of the FRP tread unit according to the fifth embodiment of the present invention.

FIG. 8 is a sectional view of the cleat portions of a tread molding substrate and a riser molding substrate according to Embodiment 5 of the present invention. In this embodiment, for the molding substrates, a hollow fabric that is woven with the same plain-weave structures for both the cleat portion of the tread and the cleat base portion is used. Both are woven while meeting at the cleat base portion 24. Further, for the tread reinforcing member, a similar molding substrate, which is a fabric woven with the plain-weave structure is used and arranged at the side opposite to the cleat base portion as shown in FIG. 9. Other than that, such pile-weave structures as woven fabrics and multi-axial braid structures as braids can also be used for the molding substrates.

Embodiment 6

Figure 10:
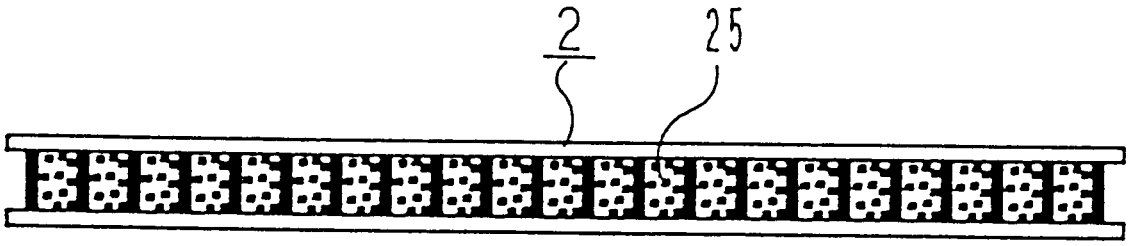
FIG. 10 is a sectional view of a tread reinforcing member of an FRP tread unit according to a sixth embodiment of the present invention.

FIG. 10 is a sectional view of a tread reinforcing member according to Embodiment 6 of the present invention. A molding substrate and molding conditions are similar to those of Embodiment 1. In this embodiment, a resin is charged into the mold with the spaces in the ribs of the tread reinforcing molding substrate filled with a polyethylene foam 25 at the time of RTM-based integral molding. As a result of this arrangement, mechanical noise at the lower portion of each step propagated through the spaces from the step driving portion can be reduced by 10 dB compared with the conventional aluminum die cast tread unit. Other materials such as urethane foam and phenol foam can also be used as the filler.

Embodiment 7

Figure 11:
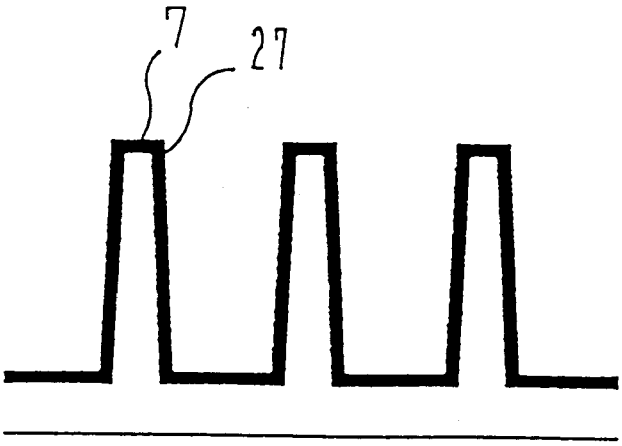
FIG. 11 is a sectional view of the cleat portion of a tread of an FRP tread unit according to a seventh embodiment of the present invention.

FIG. 11 is a sectional view of the cleat portion of a tread according to Embodiment 7 of the present invention. A surface treated layer 27 is provided in consideration of improving the wear resistance of the cleat portion 7 and traction at the tread. The surface treated layer is formed by coating with a surface treated layer precursor shown in Table 2 by brushing or spraying, and then by hardening the coating in an oven. The thickness of the surface layer is about 100 $\mu$m. Since resins having similar compositions are used for both the surface treated layer and the surface of the matrix resin of the cleat portion, this technique provides no interface between both surfaces. Therefore, a surface layer having an extremely strong bond can be provided. Further, the filler is not mixed into the molding substrate, and thus the condition in which the filler is uniformly dispersed over the surface of the cleat portion can be implemented. Instead of the filling quartz shown in Table 2, mica may be used.

While the cleat portion of the tread has been described above, the surface of the cleat portion of the riser may be treated as follows. A precursor obtained by mixing a wax into a resin is used so that the coefficient of friction is reduced in order to provide a surface layer that can prevent objects from being caught.

TABLE 2

Composition of Surface Treated Layer Precursor

| Material | Percentage by weight |
|---|---|
| Epoxy acrylate resin | 84.5 |
| Quartz sand | 7.0 |
| Quartz powder | 8.5 |

Embodiment 8

Table 3 shows the construction of a surface treated layer precursor and a matrix resin in Embodiment 8. By coloring the matrix resin and the surface treated layer resin at the time of RTM molding in this way, the whole FRP tread unit can be colored as desired. Further, by coloring the reinforcement fibers, diversified aesthetic expressions can be added to the tread unit, thereby improving the aesthetic design as well.

TABLE 3

Construction of Surface Treated Layer Precursor and Matrix Resin for Colored Tread Unit

| Material | | Percentage by weight |
|---|---|---|
| Surface treated layer precursor | Epoxy acrylate resin | 84.0 |
| | Quartz sand | 8.0 |
| | Color paste (pigment) | 8.0 |
| Matrix resin | Epoxy acrylate resin | 42.5 |
| | Aluminum hydroxide | 37.5 |
| | Colored mica | 12.0 |
| | Color paste (pigment) | 8.0 |

Embodiment 9

Figure 12:
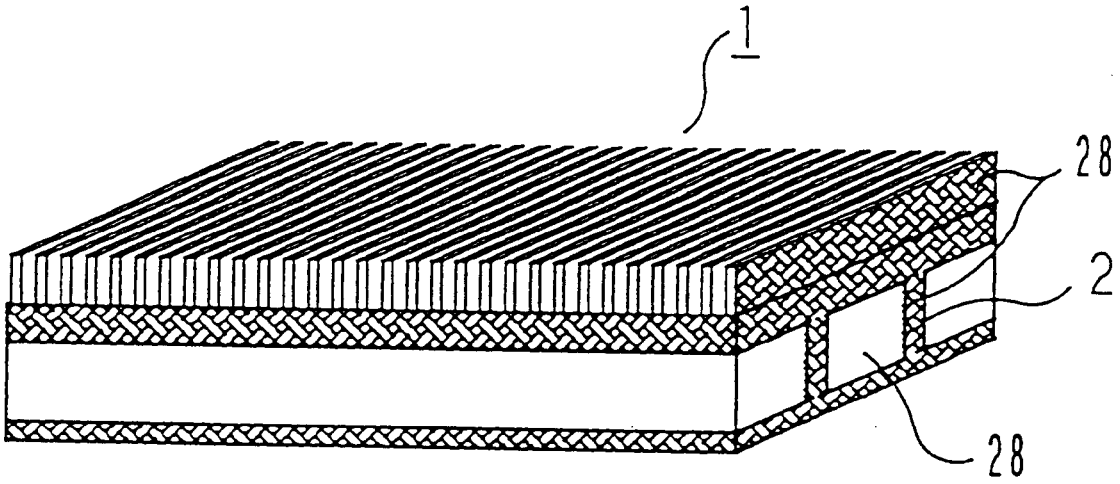
FIG. 12 is a sectional perspective view of a tread portion according to a ninth embodiment of the present invention.
Figure 13:
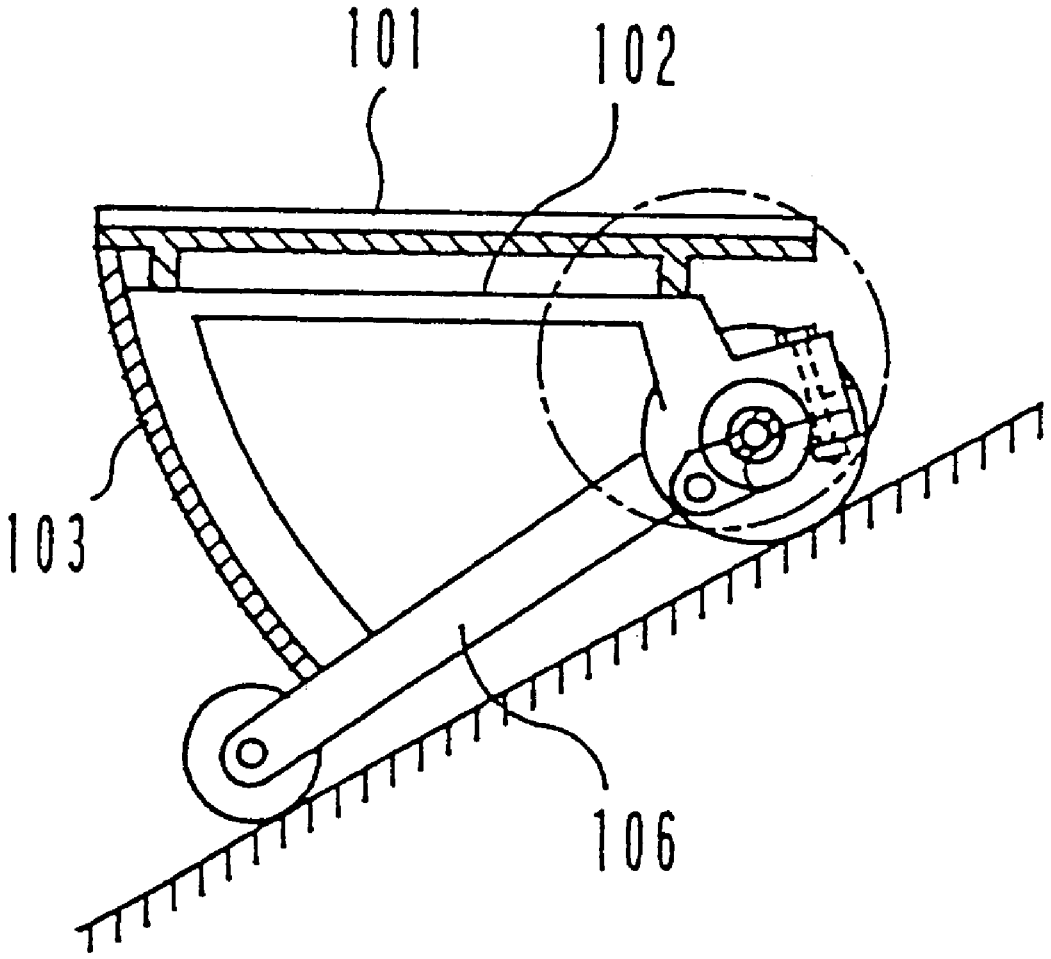
PRIOR ART FIG. 13
FIGS. 13 and 14 are perspective views of a conventional tread unit of an escalator.
Figure 14:
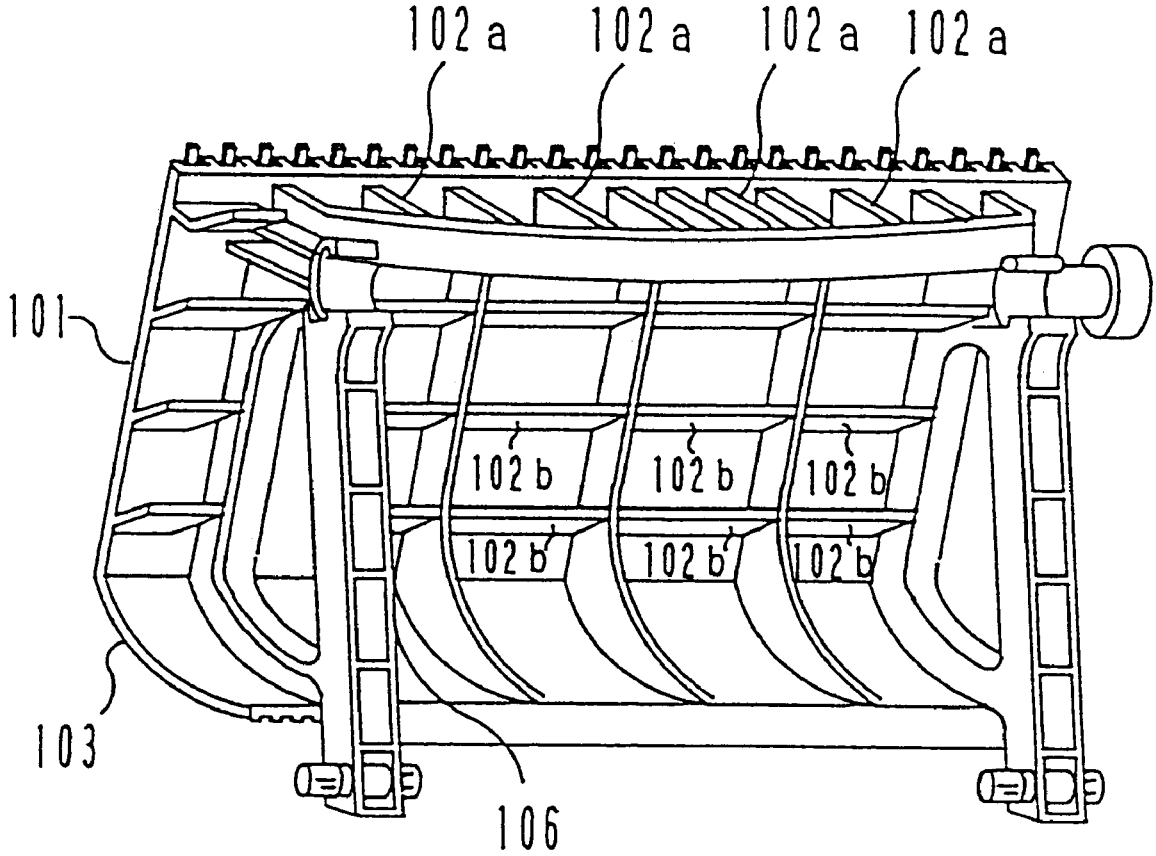
PRIOR ART FIG. 14

FIG. 12 is a sectional perspective view of a tread portion in Embodiment 9. The tread portion is reinforced by a three dimensional knitted molding substrate in which a thermoplastic resin 28 that is a matrix resin having a rubber-like elasticity is arranged at the cleat portion and reinforcing rib portions 2 of the tread 1, so that the tread portion maintains a prescribed rigidity and strength. As a result, the rigidity of the cleat portion of the tread is improved, and thus the unstable ride of conventional treads can be eliminated. Other than that, thermosetting resins and liquid rubbers similarly having a rubber-like elasticity can be used as the matrix resin.

Embodiment 10

When an escalator or a moving walk is constructed by coupling a plurality of tread units for a passenger conveyor shown in the aforementioned Embodiments 1 to 9, a downsized passenger conveyor with an adequate strength and an aesthetic design can be constructed.

Industrial Applicability

A tread unit of a passenger conveyor of the present invention is applied to people mover systems such as escalators.

What is claimed is:

1. A tread unit of a passenger conveyor comprising:

a tread portion onto which a load is applied and having an obverse surface, a reverse surface, and a cleat portion on the obverse surface;

a reinforcing portion on the reverse surface of said tread for reinforcing said tread; and a riser portion having a front surface and a cleat portion on the front surface and projecting downward from one end of said tread portion, wherein at least one of said tread portion and said riser portion is made of fiber reinforced plastic reinforced with a reinforcement made of knitted continuous fibers.

2. The tread unit of a passenger conveyor according to claim 1, wherein at least one of said tread portion and said riser portion is made of a fiber reinforced plastic reinforced with a reinforcement made of continuous fibers knitted in three dimensions in accordance with a pitch of said cleat portion.

3. The tread unit of a passenger conveyor according to claim 1, wherein one of said cleat portion of said tread portion and said riser portion includes wear resistant means and friction characteristic control means.

4. The tread unit of a passenger conveyor according to claim 1, wherein said reinforcing portion is made of a resin reinforced with a reinforcement made of a plurality of continuous fibers.

5. The tread unit of a passenger conveyor according to claim 4, wherein said reinforcement of said reinforcing portion includes an elastic resin matrix.

6. The tread unit of a passenger conveyor according to claim 4, wherein said reinforcing portion includes noise insulation means.

7. The tread unit of a passenger conveyor according to claim 4, wherein at least two of (a) said tread portion, (b) said reinforcing portion, and (c) said riser portion which are constructed of fiber reinforced materials are connected by fibers.

8. The tread unit of a passenger conveyor according to claim 1, wherein the fibers of said reinforcement are colored.

9. A passenger conveyor system comprising:

a plurality of tread units coupled to one another, each tread unit including:

a tread portion onto which a load is applied and having an obverse surface, a reverse surface, and a cleat portion on the obverse surface;

a reinforcing portion on the reverse surface of said tread for reinforcing said tread; and a riser portion having a front surface and a cleat portion on the front surface and projecting downward from one end of said tread portion, wherein at least one of said tread portion and said riser portion is made of fiber reinforced plastic reinforced with a reinforcement made of knitted continuous fibers.

10. The tread unit of a passenger conveyor according to claim 4, wherein the fibers of said matrix resin are colored.

* * * * *